United States Patent [19]

Loibl

[11] Patent Number: 5,035,561

[45] Date of Patent: Jul. 30, 1991

[54] APPARATUS FOR BINDING LEAVES WITH HEAT

[75] Inventor: Bernd Loibl, Konigsbrun, Fed. Rep. of Germany

[73] Assignee: Ibico Inter Binding G.m.b.H., Lottstetten, Fed. Rep. of Germany

[21] Appl. No.: 469,863

[22] Filed: Jan. 24, 1990

[30] Foreign Application Priority Data

Jan. 27, 1989 [CH] Switzerland ..... 279/89

[51] Int. Cl.[5] ..... B42B 5/00

[52] U.S. Cl. ..... 412/33; 412/900

[58] Field of Search ..... 412/900, 33

[56] References Cited

U.S. PATENT DOCUMENTS

| | | | |
|---|---|---|---|
| 3,928,119 | 12/1975 | Sarring | 412/900 |
| 3,954,548 | 5/1976 | Polit | 412/900 X |
| 4,108,713 | 8/1978 | Weisz | 412/900 X |
| 4,129,471 | 12/1978 | Rome . | |
| 4,141,100 | 2/1979 | Domroe et al. | 412/900 X |
| 4,385,225 | 5/1983 | Giulie . | |

FOREIGN PATENT DOCUMENTS

| | | |
|---|---|---|
| 0022878 | 1/1981 | European Pat. Off. . |
| 3514220 | 10/1986 | Fed. Rep. of Germany . |
| 3702529 | 6/1988 | Fed. Rep. of Germany . |

*Primary Examiner*—Paul A. Bell

*Attorney, Agent, or Firm*—Blum Kaplan

[57] ABSTRACT

An apparatus for binding page edges with heat, wherein adhesive is attached to at least one such page edge is provided. The apparatus includes an elongated heat-conducting bar of a length generally corresponding to the length of the page edges to be bound and has a longitudinal slot below for receiving a PTC resistance heating element connected to a power source disposed between two electrically conductive fillets.

15 Claims, 2 Drawing Sheets

APPARATUS FOR BINDING LEAVES WITH HEAT

BACKGROUND OF THE INVENTION

This invention is directed to an apparatus for binding the edges of leaves with heat, and in particular, to an apparatus for binding pages with a heat sensitive adhesive attached to at least one such page edge.

Methods of binding pages together, either just with each other or to an outside cover, are known in the art. These methods are used to make books, brochures, and the like. One such method involves gluing page edges to the spine of a folder using a heat-activated adhesive, resulting in a thermoplastic bond between the pages or the pages and the folder. An apparatus which accomplishes this thermal binding is described in Federal Republic of Germany Patent No. 37 02 529. This apparatus is equipped with a heating element for melting and gluing an adhesive bead to the spine of the folder to be produced. This heating element has a resistance unit controlled by a adjustable thermostat by means of a suitable circuit.

The disadvantage of this apparatus is the complexity of the thermostat and temperature control circuit.

Accordingly, a less elaborate apparatus for producing thermal heat binding is desired.

SUMMARY OF THE INVENTION

Generally speaking, in accordance with the invention, an apparatus for binding pages with heat including an elongated, heat-conducting bar having one substantially planar surface upon which the page edges to be bound may be positioned is provided. The heat-conducting bar is provided with a slot on the opposite side of the planar surface and a PTC resistance heating element is positioned within the heat-conducting bar for heating the planar surface. A pair of electrically conductive bars are positioned on both sides of the PTC resistance heating element and are connected to a power source.

Accordingly, it is an object of the invention to provide an improved apparatus for binding page edges with heat.

Another object of the invention is to provide an uncomplicated apparatus for binding page edges with heat.

A further object of the invention is to provide apparatus for binding page edges with heat which is relatively inexpensive.

Still another object of the invention is to provide an apparatus for binding page edges with heat which requires minimal maintenance.

Still other objects and advantages of the invention will in part be obvious and will in part be apparent from the specification.

The invention accordingly comprises the features of constructions, combination of elements, an arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
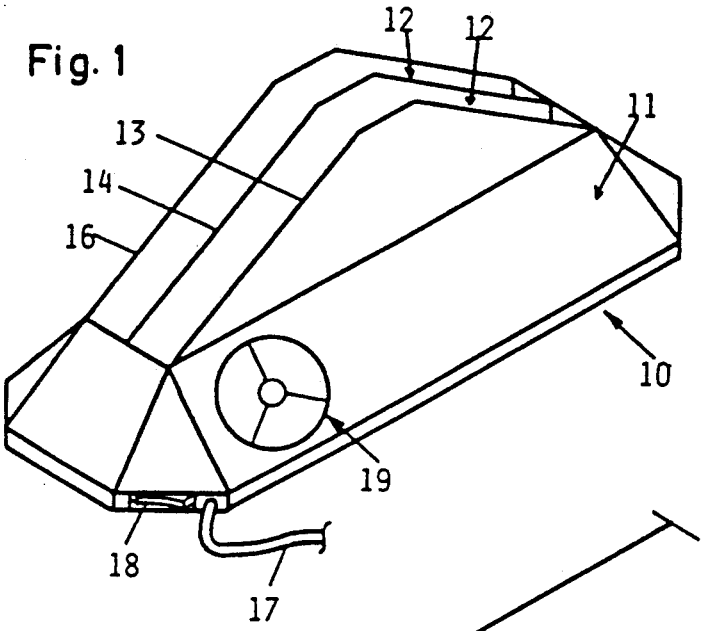
FIG. 1 is a perspective view of an example of an apparatus for binding page edges with heat constructed and arranged in accordance with the invention.

FIG. 1 depicts an apparatus for binding leaves in accordance with the invention generally identified as 10. Binding apparatus 10 includes an elongated, relatively flat case 11 having hollow spaces 12 into which leaves, such as pages, small folders, and the like which are to be bound, can be inserted with the spine on the inside. The leaves which may be bound may be made of paper, cardboard, plastic, foil of any type such as thin metal foil, or similar materials. Binding apparatus 10 may be used for binding two or more pages to each other or to the spine of a folder or other suitable cover material.

Binding apparatus 10 includes three essentially triangular plastic plates 13, 14, and 16 which divide the binding region into two hollow spaces 12 into which two groups of pages to be bound can be inserted simultaneously. Case 11 is equipped with a connection cable 17 for coupling to an electrical power source controlled by a switch 18, as well as with a control panel 19 which may operate by touch and contain luminous displays. A heat-conducting bar 21 is positioned under the top surface of case 1 between plates 13, 14 and 16 and is shown in FIG. 2.

Figure 2:
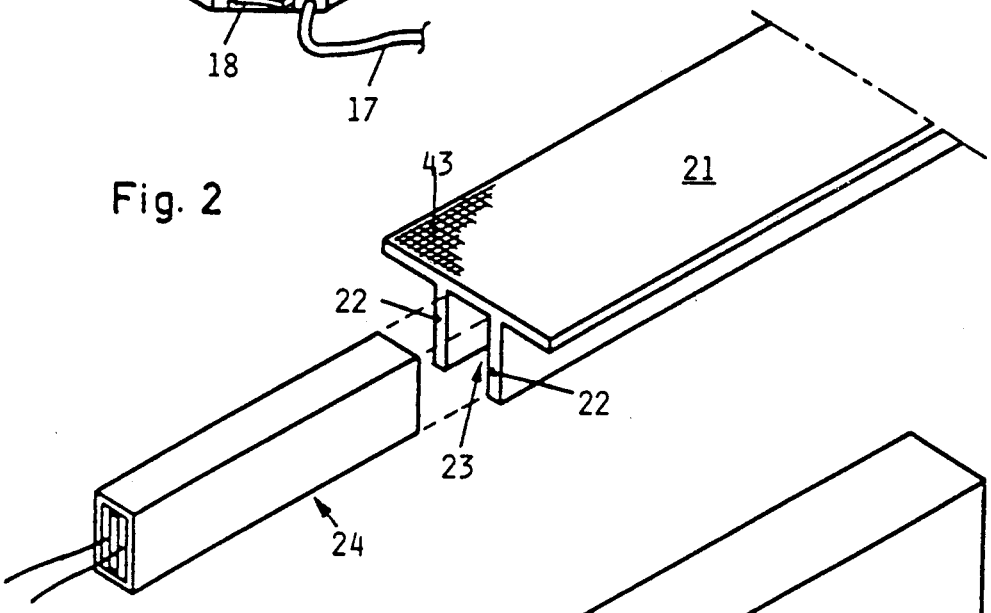
FIG. 2 is a perspective view of the heating assembly included in apparatus for binding page edges of FIG. 1.

Attention is now directed to FIG. 2 which depicts heat-conducting bar or bar unity 21 having a flat top surface and a pair of perpendicular legs 22 forming a longitudinal slot 23 therebetween. The width of bar 21 conforms to the distance between plates 13 and 16 (FIG. 1), in such a manner that the pages or the spine of an inserted folder can lie on the flat surface of bar 21. At least one heating element 24 fits into longitudinal slot 23, which forms a heating assembly with bar 21.

Figure 3:
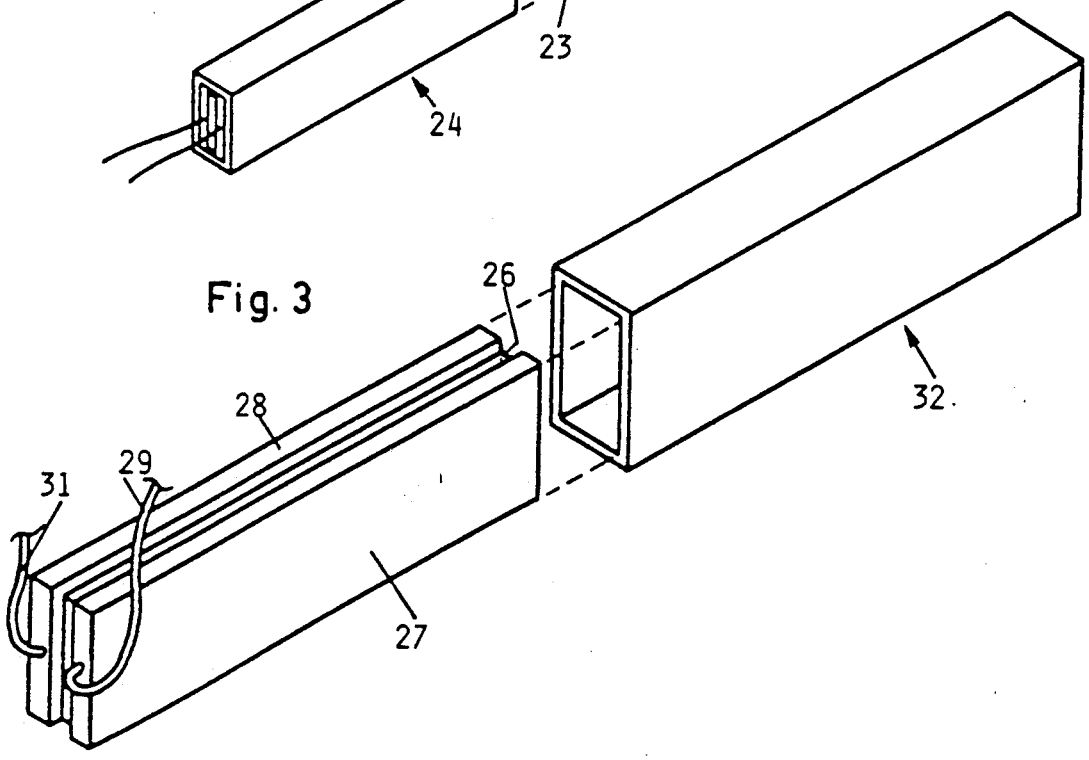
FIG. 3 is a perspective view of the heating element in the heating assembly of FIG. 2.

Referring now to FIG. 3, the details of heating element 24 are shown. Heating element 24 includes a thin narrow strip of PTC resistance or fillet 26, positioned between two heat and electricity-conducting fillets 27 and 28. Conducting fillets 27 and 28 may be made of aluminium and each is connected to an electricity source by a wire 29 and 31, respectively. Preferably, an insulating sheath 32 is positioned about the fillets to hold fillets 28, 29 and 31 together. Sheath 32 preferably is formed of an electrically insulating and thermally conducting material, such as an external envelope of temperature-stable silicone rubber.

Figure 4:
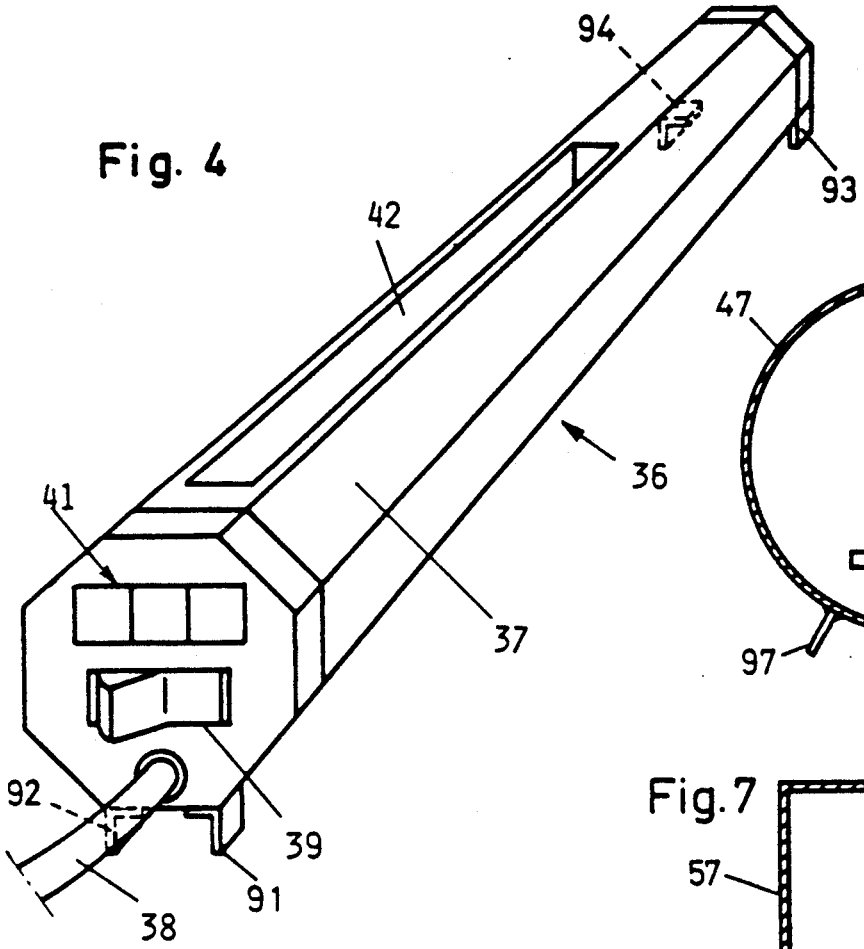
FIG. 4 is a perspective view of an apparatus for binding page edges with heat in accordance with a second embodiment of the invention.
Figure 5:
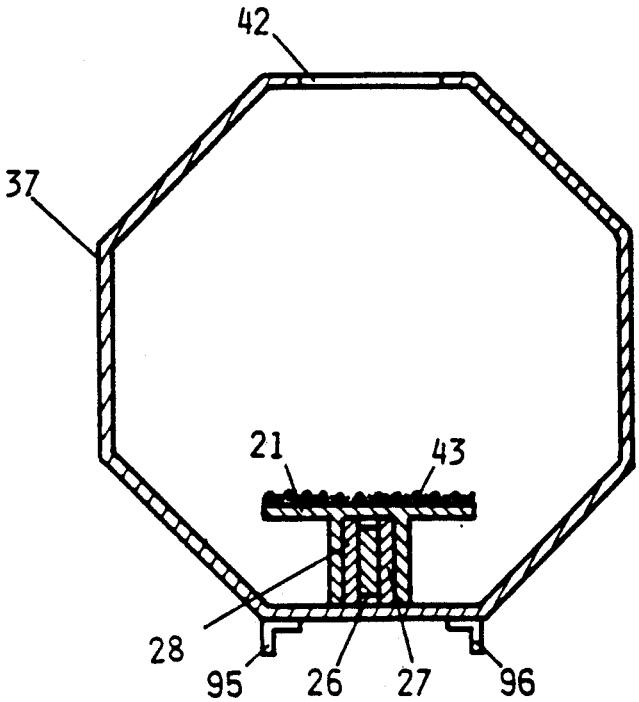
FIG. 5 is a cross-sectional view of the apparatus depicted in FIG. 4.

Attention is now directed to FIGS. 4 and 5 which show a leaf binding apparatus 36 assembled in accordance with a second embodiment of the invention. Binding apparatus 36 includes an elongated case 37 having an octagonal cross-section. Apparatus 36 is not equipped with plates 13, 14, and 16 as apparatus 10. However, apparatus 36 can include wire clips (not shown) to hold on the side the pages, folders, and the like. On one edge of case 37 is provided with a power cable connection 38, a switch 39, and a control panel 41. One of the octagonal sides of case 37 is formed with a longitudinal slot 42 for receiving the leaves in a width conforming to the width of heating bar 21 positioned within case 37 on an opposite inside surface from slot 42. Heating bar 21 may also be covered with a thin insulating layer such as a glass fiber layer 43 (FIG. 2).

When a binding apparatus in accordance with the invention is turned on, operation is as follows. Referring to FIG. 3, electricity flows directly from a power supply through the series connection of wire 31, conducting fillet 28, PTC resistance fillet 26, conducting fillet 27 and wire 29 without requiring transformer and/or a rectifier. Provided the PTC resistance material is properly selected, a relatively constant temperature of e.g. 170° C. can be attained on the surface of heat bar 21 with a continuous wattage. Particularly, a value of 20 to 25 watts conforms to the temperature currently recommended by suppliers of adhesive materials for binding leaves. It is within the scope of the invention that completely different temperature values also may be possible. The heating device arranged in accordance with the invention preferably includes three heating components which are inserted longitudinally one after the other into slot 23 in order to obtain a suitable temperature distribution. To this end, heating bar 21 may also, be covered with a thin insulating layer, such as glass, teflon, etc. fiber layer 43.

The heating device constructed and arranged in accordance with the invention is auto-regulating. The PTC resistor cools slightly when pages at or near room temperature are inserted into the apparatus and in contact with the top surface of the heating bar. When the PTC resistor drops in temperature, electrical conduction increases which draws more power from the power supply until the pages are heated, a process which occurs rapidly. Once the pages reach the same temperature as the PTC resistor, the resistor return to normal power consumption Control panel 41 serves to input the predetermined time necessary to complete the gluing process. At the end of gluing a luminous display lights up to indicate that the gluing process is complete.

Internally, binding apparatus 10 of FIG. 1 and apparatus 36 of FIG. 4 are constructed in the same manner. The principal difference being that the apparatus 10 may include two parallel heating bars 21 aligned next to each other. If apparatus 10 includes one bar 21, the other bar may be one which electronically cooled or may simply be a perforated plate which generates air cooling. Apparatus 10 may be equipped with a single heating bar 21 and include only two supporting plates with the width of bar 21 conforming to the distance between the plates. In such an embodiment cooling of a bound small folder will take place outside the apparatus, for example, when the bound pages are placed on a table.

Figure 6:
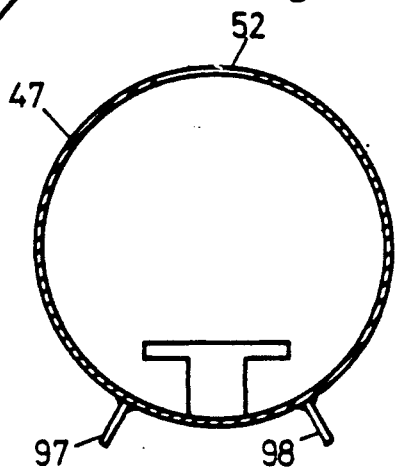
FIG. 6 is a cross-sectional view of a third embodiment of the invention.
Figure 7:
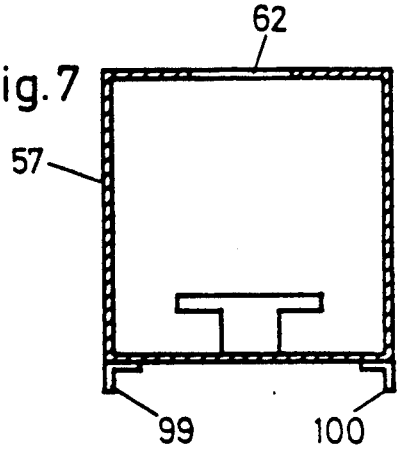
FIG. 7 is a cross-sectional view of a fourth embodiment of the invention.

The binding apparatuses constructed and arranged as shown in FIGS. 1 and 4 can be equipped with a photoelectric circuitry and a timer in such a manner that, after new pages have been inserted, a luminous display lights up after a pre-determined time period in order to indicate that the pages are to be removed. The external shape of the apparatus case also may be other shapes. A round cross-sectional case 47 is depicted in FIG. 6 with slot 52, and a rectangular cross-sectional case 57 is shown in FIG. 7 with slot 62. The case can also may be equipped with small legs or supports, such as shown in FIGS. 4–7 at numerals 91–100, which are particularly important when the apparatus is to be held at a higher level on a table in order to allow for air ventilation. An example of an apparatus which might particularly require ventilation is the type shown in FIG. 1, wherein a cooling bar has a width which conforms to the distance between plates 14 and 16, and which may be inserted on the internal floor of case 11 next to bar 21. This would allow for simultaneous heating of one group of pages and cooling of a previously heated group of pages. Heating bar 21 can also be arranged in such a manner that its upper surface is slightly cylindrical-concave, or that the longitudinal slot is arranged on the slide instead of on the bottom.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall interpreted as illustrative and not in a limiting sense.

It is also to be understood that the following claims are intended to cover all of the generic and specific features of the invention herein described and all statements of the scope of the invention which, as a matter of language might be said to fall therebetween.

PTC resistors are manufactured with certain semiconductor materials like e.g. $BaTiO_3$ and/or $SrTiO_3$ and with other substances

What is claimed is:

1. An apparatus for binding the edges of leaves, such as pages, small folders, and the like, with heat, wherein a heat-sensitive adhesive is attached to at least one such edge, comprising:

an elongated case having at least one opening into which the edges of leaves which are to be bound can be inserted, said elongated case including a connection cable having at least one conductor and which is capable of coupling to an electrical power source and is controllable by a switch;

an elongated heat-conducting member positioned in the elongated case under said opening and having a substantially planar top surface, said elongated heat-conducting member having a length which generally corresponds to the length of the edges to be bound and a width which conforms to the width of said opening in such a manner that the edges of the leaves can lie on the top surface, and said heat-conducting member including a pair of legs on the bottom surface and extending away to form a longitudinal slot therebetween;

at least one heating element which fits into said longitudinal slot and forms a heating assembly with said elongated heat-conducting member, wherein said heating element includes two heat and electricity-conducting fillets with a thin narrow strip of PTC resistance material positioned therebetween, each fillet being connected to one of the conductors of the connection cable; and an insulating sheath positioned about the fillets to hold said fillets together, wherein said sheath is formed of a substantially electrically-insulating and thermally-conducting material.

2. The apparatus of claim 1, wherein the elongated heat-conducting member has an essentially $\pi$-shaped cross-section.

3. The apparatus of claims 1, wherein the elongated heat-conducting member is essentially a bar.

4. The apparatus of claim 1, wherein the elongated heat-conducting member includes a thin insulating layer on its top surface.

5. The apparatus of claim 1, including three essentially triangular plastic plates which divide the binding region into two elongated openings into which two groups of edges of leaves to be bound can be inserted simultaneously.

6. The apparatus of claim 1, wherein the case has an octagonal cross-section.

7. The apparatus of claim 1, wherein the case has a substantially round cross-section.

8. The apparatus of claim 1, wherein the case has a substantially rectangular cross-section.

9. The apparatus of claim 1, further including supports at the bottom of the case to support the case.

10. The apparatus of claim 9, wherein the supports are legs.

11. The apparatus of claim 1, including control means for regulating operation of the heating element.

12. The apparatus of claim 11, wherein the control means includes a control panel mounted on the case.

13. The apparatus of claim 12, wherein the control panel is operated by touch and contains luminous displays.

14. The apparatus of claim 1, wherein the fillets are made of aluminum.

15. The apparatus of claim 1, wherein the insulating sheath is made of silicone rubber.

* * * * *